United States Patent [19]

Weist

[11] 4,065,344

[45] Dec. 27, 1977

[54] BAG FORMING METHOD AND APPARATUS

[75] Inventor: Herman C. Weist, Louisville, Ky.

[73] Assignee: Weist Industries Inc., Louisville, Ky.

[21] Appl. No.: 590,298

[22] Filed: June 25, 1975

[51] Int. Cl.[2] ..... B31B 23/14; B31B 23/60; B31B 49/04

[52] U.S. Cl. ..... 156/250; 93/33 H; 93/35 R; 93/DIG. 1; 156/267; 156/497; 156/498; 156/510

[58] Field of Search ..... 156/251, 515, 267, 285, 156/497, 498, 250, 510; 93/33 H, 35 R, DIG. 1; 83/53, 171

[56] References Cited

U.S. PATENT DOCUMENTS

| | | | |
|---|---|---|---|
| 2,800,163 | 7/1957 | Rusch | 156/267 |
| 3,384,528 | 5/1968 | Lehmacher et al. | 156/515 |
| 3,558,406 | 1/1971 | Kugler | 156/515 |
| 3,575,763 | 4/1971 | Ramsey | 156/515 |
| 3,586,577 | 6/1971 | Bella | 156/351 |
| 3,813,998 | 6/1974 | Lotto | 156/498 |

*Primary Examiner*—William A. Powell
*Assistant Examiner*—M. G. Wityshyn
*Attorney, Agent, or Firm*—Edward M. Steutermann

[57] ABSTRACT

The present invention provides a method and apparatus for the manufacture of generally rectangular plastic bags from a gusseted or flattened tubular, supply stock where the bags terminate in heat sealed closure at the bottom and the end opposite the bottom is generally open.

The method provided by the present invention includes feeding selected stock of elongate gusseted or flattened tubular plastic material, in a direction along the longitudinal axis of the material to heat seal bar means, sealing a portion of the tubular stock together, by heating the material, along a line generally transverse to the direction of movement of the stock to form the bottom of a first bag, and at generally the same time cutting the stock along a line transverse to the direction of travel of the stock at a location a selected distance from the seal bar in the direction of travel of the stock to form the open end of a second bag and, while the heat seal bar is in contact with the stock, exerting a force on the tail portion of the stock between the cut and the sealing bar to break the tail portion away from the seal formed by the sealing bar.

5 Claims, 4 Drawing Figures

BAG FORMING METHOD AND APPARATUS

BACKGROUND OF THE INVENTION

Various devices, as shown in Weist U.S. Pat. No. 2,882,956 have been provided to form plastic bags from gusseted or flattened tubular plastic stock material, where the bags are formed by feeding the material through cutting and heat sealing steps to form a closure longitudinally across the tube to provide the bottom end of a first bag and the tube is then cut at a selected location separated from the heat sealed closure to form the open end of a second bag where the bottom end of the second bag has been sealed during a previous sealing operation.

The plastic bags so formed have had a tail section carried by the closure which is equal in length to the distance between the heat seal and the cutter. The tails provided on such plastic bags are not only unattractive, they also detract from the functionality or usefulness of the bag in certain applications.

SUMMARY OF THE INVENTION

The present invention provides a method and apparatus for the production of a "tailless" plastic bag which is attractive in appearance and is particularly useful in applications where the tail provided by previous plastic bags is not desirable or makes the bags unusable.

More particularly, the present invention provides a method of producing a "tailless" plastic bag which includes advancing an elongate gusseted flattened tube, of plastic stock material in a direction parallel to the longitudinal axis of the stock material, forming a bottom end of a first bag by sealing the overlying layers of the material along a line transverse to the axis of travel of the material, cutting the material at a location in advance of the seal to form the opening for a second, previously formed, bag, and exerting a force on the portion of the material between the cut portion and the heat seal generally simultaneously with the heat seal operation to remove the portion of the material between the heat seal and the cut portion.

Various other features of the present invention will become obvious to those skilled in the art upon reading the disclosure set forth hereinafter.

DESCRIPTION OF THE DRAWINGS

Referring now to the drawings which illustrate one example of an appartus and method in accordance with the present invention:

FIGS. 3A and 3B are schematic illustrations of the operation of one device in accordance with the present invention.

Referring to FIG. 1 which shows one example of a bag forming apparatus which is useful on the present invention, the apparatus comprises a frame structure 1 with rearwardly extending arms 2 and 3 having bearings 4 at their adjacently spaced ends for mounting a spindle 6. Spindle 6 carries a roll of gusseted or flattened tubular, plastic stock material 7 to be used in making the bags by a pre-determined, spaced, cutting of the material at one end of the stock and sealing of the opposite end as herein described. The stock material 7, for example a gusseted flattened polyethylene tube, is reeved around a bar 8 mounted between a front part arms 2 and 3 and is then passed upwardly and over a second bar 9 mounted between upper bracket members 11 and 12 then downwardly around and under a transverse bar 13, journaled between a pair of bracket arms 14 and 16 and thence upwardly and over another guide bar 17 supported between arms 11 and 12 and downward under a bar 18 journaled between arms 14 and 16 and finally upward and forward over the rounded edge of a material feed table 19 to the several working stations hereinafter described.

Figure 1:
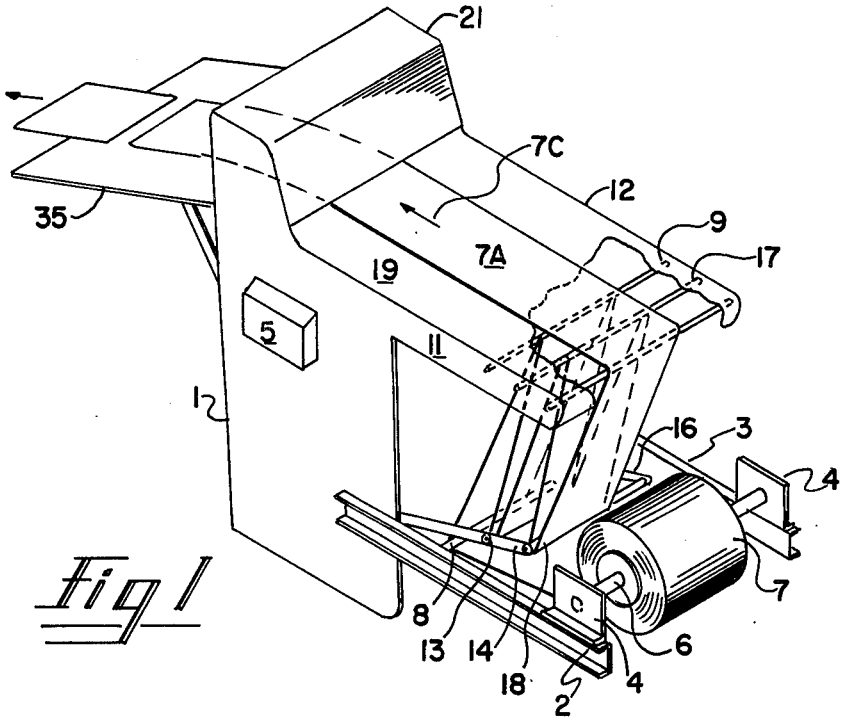
FIG. 1 is an example of one device for production of plastic bags in accordance with the present invention.

Bracket arms 14 and 16 are pivotably carried by frame and can be biased, for example by springs, to regulate tension on the web 7A withdrawn from supply roll 7 as described in U.S. Pat. No. 2,882,956.

In summary, the web from stock roll 7 extends forward between the feed rollers aforenoted to the bag forming stations as described hereinafter.

Web 7A is fed over feed table 19, in the direction shown by arrow 7C, to bag forming apparatus, described hereinafter, carried in hood 21, as shown partially in FIG. 2.

It will be understood that various web feeding arrangements may be used to supply web 7A to be formed into bags and one such arrangement is shown in Weist U.S. Pat. No. 2,882,956 where the web is fed to sealing and cutting stations as described hereinafter.

Referring to FIGS. 3A and 3B illustrate, schematically, one arrangement in accordance with the present invention to feed, cut and seal web 7A where web 7A is fed between feed rollers 22 and 23. Roller 22 is connected to be driven, by clutch and brake 24 by means of chain 26 as described in U.S. Pat. No. 2,882,956. Roller 23 is an idler roller to provide a nip for advancement of web 7A upon rotation of drive roller 22. Clutch/brake 24 is adapted to be driven by drive means (not shown) and controlled by means described in U.S. Pat. No. 2,882,956, to be selectively rotated to advance web 7B intermittently a preselected distance approximately the length of the bag to be fabricated. At the conclusion of each intermittent advance of web 7A, the web is positioned in the cutter/sealer section 27 as shown in FIG. 3A. Clutch/brake 24 then stops movement of web 7A during the cutting and sealing operation described hereinafter. Cutter/Sealer section 27 includes a heat seal bar 28 and backup platten 31, also shown in perspective in FIG. 2, and fixed cutter bar 29A as well as a moveable cutter bar 29 to selectively cut web 7A. Cutter bars 29 and 29A, as shown, are located a selected distance from sealer bar 28 in the direction of travel of web 7A.

Figure 2:
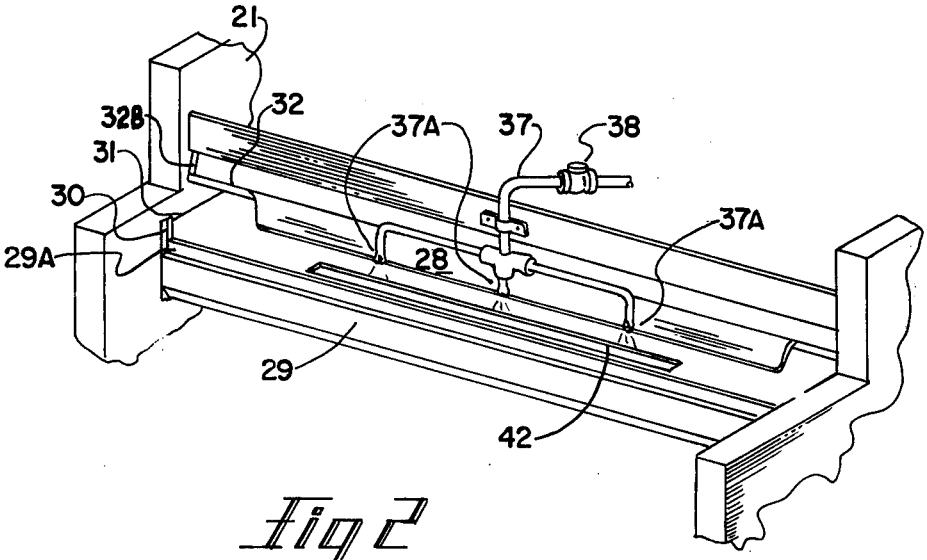
FIG. 2 is a perspective view of one example of a cutter bar and heat seal arrangement showing one means of exerting a force on a portion of the material formed in accordance with the present invention.
Figure 7A:
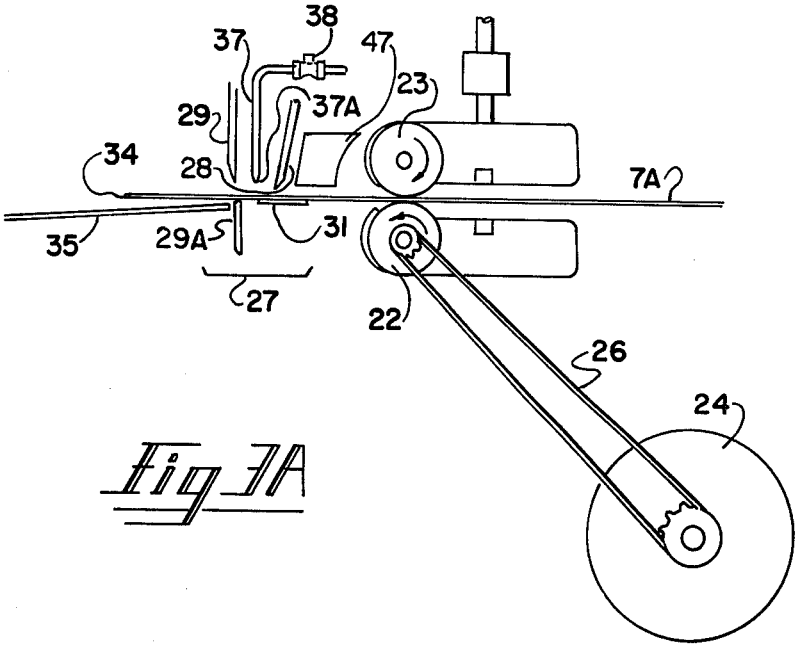
Figure 7B:
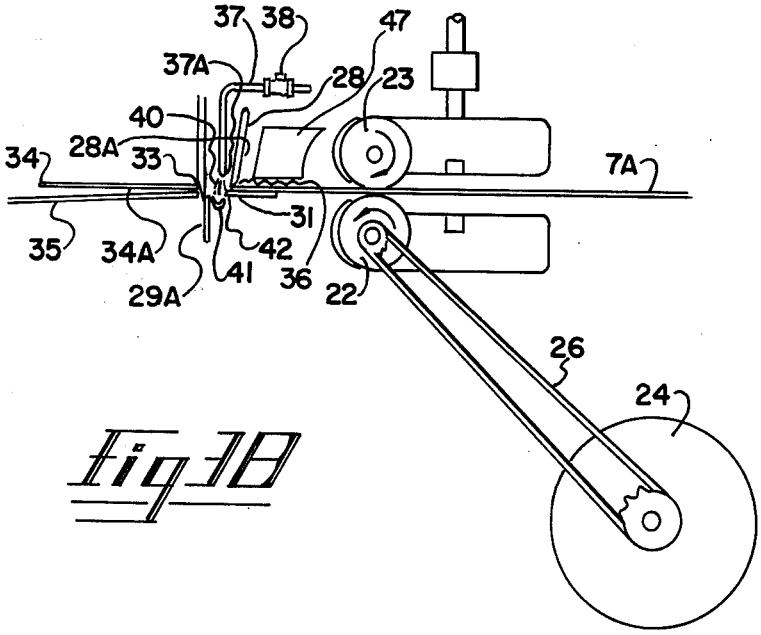

Platten 31 is provided across the width of web 7A, as shown in FIG. 2 to receive sealer bar 28 so that web 7A is pinched between bar 28 and platten 31, as shown in FIG. 3B. Sealer bar 28 is carried by an operator arm 32 which is intermittently driven by operator means (not shown) in a generally vertical direction toward platten 31 in a slot 32B provided in hood 21 so that a sealing edge 28A of sealer bar 28 moves in a generally vertical path into and out of contact with platten 31 and web 7A. Sealing edge 28A can be heated, for example electrically, to provide means to seal or weld the layers of web 7A together along a line defined by the line of contact of sealing edge 28A of the sealer bar 28, which extends across web 7A transverse to the direction of travel of web 7A, to form the bottom end 34 of a second bag 34A as shown in FIG. 3B and described hereinafter.

An opening 42 can be provided in platten 31 to receive the tail portion removed from bags as described hereinafter.

Fixed cutter blade 29A is provided as shown in FIG. 2 to extend across the width of web 7A between the sides of hood 21 and is advantageously located beneath web 7A parallel to, but offset slightly from, cutter bar 29 so that upon downward vertical movement of moveable cutter bar 29, cutter bar 29 and fixed blade 29A cooperatively cut web 7A to form an opening 33 to a second bag where the bottom closure 34 has been formed by sealing edge 28A, as illustrated in FIG. 3B during a previous sequence of operations as described hereinbefore.

As shown in FIG. 2, cutter bar 29 is disposed for vertical movement in a slot 30 provided in the side of frame 21 and can be moved from open position as illustrated in FIG. 3A to closed position illustrated in FIG. 2 and 3B by operator means carried in hood 21 (not shown).

In accordance with another feature of the present invention a cooling means, for example a chilled water heat exchange 47 can be provided between drive rollers 22, 23 and sealer bar 28 to cool web 7A and drive rollers 22 and 23 prior to sealing and cutting. It has been found that cooling web 7A and drive rollers 22 and 23 prior to sealing and cutting significantly improves operation of the apparatus provided by the present invention.

In accordance with one feature of the present invention, means are provided to exert a force on the portion of web 7A between cutter bar 29 and sealer bar 28 when sealer bar 28 is in position to form the bottom of a bag. In the example shown, the force is exerted by means of compressed air emitted from selectively spaced outlets 37A of a compressed air manifold 37 which, as shown, can be mounted adjacent sealer bar 28. Compressed air can be intermittently supplied to manifold 37 by means of a solenoid valve 38 which is interconnected, by means known in the art, with operation of clutch brake 24 cutter bar 29 and heat seal bar 28 as described more particularly hereinafter.

OPERATION

The mechanism to feed web 7A to cutter and sealer station 21–27 can be substantially as described in detail in Weist U.S. Pat. No. 2,882,956. Briefly web 7A is advanced stepwise by intermittent rotation of roller 22 by clutch/brake 24 where the distance web 7A is advanced in any step determines the depth of the bag to be formed. When rotation of roller 22 ceases so that a section of web 7A is extended into cutter/sealer section 27 as shown schematically in FIG. 3A, the control system, for example, as contained in control box 5 and described in detail in the aforementioned patent, activates operation of cutter bar 29 and sealer bar 28 as shown in FIG. 3B so that web 7A is cut by cutter bar 29 to form the opening to bag 34A where bottom closure 34 has been formed during a previous sealing operation as described hereinafter. At this point bag 34A is fully formed and is received in table 35.

Referring to FIG. 3B, sealing edge 28A of sealer bar 28 is moved, as previously described, to contact with platten 31 to compress web 7A along the width of web 7A and form a seal 36 provide the bottom of a subsequently formed first bag.

In accordance with the present invention, while sealing edge 28A is in contact with web 7A and compressing web 7A against platten 31, a force, for example a jet 40 of compressed air from nozzle 37A, is urged against the portion 41 of web 7A between cutter bars 29 and 29A and seal bar 28/platten 31 to tear portion 41 away from the portion of web 7A caught between sealer bar 28 and platten 31. Portion 41 removed from web 7A is then emitted as scrap through opening 42 as shown. Compressed air jet 40 is controlled by a solenoid valve 38 supplied with compressed air at some period during activation of cutter bar 29 and sealer bar 28. Jet 40 as previously described is activated at a selected time and for a selected period, for example, when cutter bar 29 is through the cut and sealing edge 28A has heated the overlying sides of web 7A sufficiently to soften the material of which the web is composed, for example, polyethylene film.

As described in the aforenoted patent, sealer bar 28 is then released from platten 31 and brake/clutch 24 initiates a swift, very slight, reversal of roller 22 to clear the sealed portion of web 7A from platten 31 and sealing edge 28A, then advances web 7A as previously described to reinitiate the foregoing sequence to form new bags.

It will be recognized that the foregoing is a description of but one example of apparatus and method in accordance within the scope of the present invention and that various modifications within the scope of the present invention of the foregoing example, will occur to those skilled in the art upon reading the foregoing.

The invention claimed is:

1. A bag forming apparatus including:

a. Feed means to selectively feed a substantially continuous elongate web of flattened tubular plastic stock material in a direction parallel to the longitudinal axis of the web;

b. Heat seal means extending across a portion of said web in a direction generally transverse to the direction of travel of the web to selectively fuse opposite sides of said web to form the bottom of a first bag;

c. First control means to selectively cause said heat seal means to contact said web to fuse said opposing sides of said web together along a line generally transverse to the direction of travel of said web to form a bottom of a first bag;

d. Feed means to move said web a selected distance along the direction of travel after the bottom of said first bag is formed;

e. Cutter means disposed a selected distance from said heat seal means in the direction of travel of said web along a line generally transverse to the direction of travel of the stock to release said first bag and form an opening thereto;

f. Second control means to selectively activate said cutter means to cut said web while said heat seal means is in position to form a bottom of a second bag;

g. Tear means to selectively exert a force on a tail portion of said web between said cutter means and said heat seal means to remove said tail portion of said web between said cutter means and said heat seal means while said heat seal means is in contact with said web; and h. Cooler means disposed before said heat seal means relative to the direction of travel of said web to cool said web prior to introduction of said web to said heat seal means.

2. The invention of claim 1 wherein said web includes a flattened tubular plastic material wherein gussets are provided at at least one location around the periphery of said tubular material.

3. The invention of claim 1 wherein said tear means includes compressed air supply means to selectively direct a stream of compressed air at selected pressure at a portion of said tail portion of said web.

4. A method for formation of a plastic bag including:

a. feeding a substantially continuous elongate web of flattened tubular plastic stock material in a direction parallel to the longitudinal axis of the web;

b. fusing a portion of the upper and lower layers of said web along a line generally transverse to the direction of travel of the web to form a bottom of a first bag;

c. advancing said web a selected distance in the direction of travel thereof;

d. cutting the web along a line generally transverse to the direction of travel of the said web at a location a selected distance from the bottom of said first bag to form an open end of said first bag and generally simultaneously forming a heat seal transversely across a portion of said web a selected distance from said cut to form a bottom end of a second bag;

e. while fusing the upper and lower layers of said bottom of said second bag, exerting a force on a tail portion of said web between said bottom end of said second bag and said cut of said web to remove said tail portion from said web;

f. cooling the portion of said web to be fused prior to fusing said upper and lower layers.

5. The invention of claim 4 including exerting said force on said tail portion of said web by directing a stream of compressed air over a portion of said tail portion.

* * * * *